US009089949B2

(12) United States Patent
Hunt

(10) Patent No.: US 9,089,949 B2
(45) Date of Patent: Jul. 28, 2015

(54) AUTOMATED POLISHING SYSTEMS AND METHODS

(71) Applicant: General Electric Company, Schenectady, NY (US)

(72) Inventor: Mark Lawrence Hunt, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 135 days.

(21) Appl. No.: 13/693,253

(22) Filed: Dec. 4, 2012

(65) Prior Publication Data

US 2014/0154954 A1 Jun. 5, 2014

(51) Int. Cl.

| | |
|---|---|
| ***B24B 49/16*** | (2006.01) |
| ***B24B 19/14*** | (2006.01) |
| ***B24B 51/00*** | (2006.01) |

(52) U.S. Cl.

CPC ..... *B24B 49/16* (2013.01); *B24B 19/14* (2013.01); *B24B 51/00* (2013.01)

(58) Field of Classification Search

CPC ..... B24B 49/16; B24B 51/00; B24B 19/14
USPC ..... 451/5, 8, 9, 10, 28, 11
See application file for complete search history.

(56) References Cited

U.S. PATENT DOCUMENTS

| | | | | |
|---|---|---|---|---|
| 3,798,843 | A * | 3/1974 | Weatherell | 451/121 |
| 4,663,892 | A * | 5/1987 | Smith | 451/49 |
| 4,772,831 | A | 9/1988 | Casler, Jr. et al. | |
| 4,773,025 | A | 9/1988 | Penkar et al. | |
| 4,963,805 | A | 10/1990 | Suzuki et al. | |
| 5,028,855 | A | 7/1991 | Distler et al. | |
| 5,229,951 | A | 7/1993 | Sugita et al. | |
| 5,241,792 | A * | 9/1993 | Naka et al. | 451/24 |
| 5,441,437 | A * | 8/1995 | Hulstedt | 451/1 |
| 5,509,848 | A * | 4/1996 | Shimbara | 451/24 |
| 7,797,828 | B2 | 9/2010 | Beeson et al. | |
| 8,155,781 | B2 | 4/2012 | Birzer et al. | |
| 2004/0259471 | A1 * | 12/2004 | Antenen | 451/5 |
| 2005/0159840 | A1 | 7/2005 | Lin et al. | |

* cited by examiner

*Primary Examiner* — Robert Rose

(74) *Attorney, Agent, or Firm* — Blake A. Nickles; Ernest G. Cusick; Frank A. Landgraff

(57) ABSTRACT

Automated polishing systems include a polisher for polishing the coating on the article and a robotic positioner for moving the polisher relative to the article on an automated path, wherein the polisher polishes at least a part of the coating during movement, a force feedback sensor for determining a force of the polisher against the article during polishing, and a controller for maintaining the polisher within a predetermined force range against the article based at least in part on the force determined by the force feedback sensor.

14 Claims, 2 Drawing Sheets

AUTOMATED POLISHING SYSTEMS AND METHODS

BACKGROUND OF THE INVENTION

The subject matter disclosed herein relates to polishing coatings on articles and, more specifically, to automated polishing using force feedback.

Articles such as turbine components perform a variety of different functions and operate in many extreme environments. For example, blades, buckets, vanes and the like can be utilized throughout the compression, combustion and turbine sections for gas turbines, steam turbines and other turbine related equipment. However, each of these turbine components can have a highly-contoured profile with multiple faces, tapered edges and other potentially difficult to machine features. Moreover, due to the harsh environments in which they operate, such as elevated temperatures for hot gas path components, turbine components may have one or more additional exterior coatings. Thermal barrier coatings, for example, may be used to extend the temperature range turbine components can operate in. However, while these coatings can assist with the performance of the turbine component, they may require inspection and/or repair to help ensure quality.

For instance, turbine components can require polishing after being coated to ensure sufficient thickness and surface consistency. This may be required for both new-make parts with original coatings and repaired parts with repaired or supplemental coatings. However, due to the complicated shapes and potential defects that may be unique to each individual part, the polishing can be difficult to automate using standard robotic processes. Instead, polishing may require labor intensive attention to each part to account for specific shapes, defects or the like.

Accordingly, alternative automated polishing systems and methods would be welcome in the art.

BRIEF DESCRIPTION OF THE INVENTION

In one embodiment, an automated polishing system is disclosed for polishing an article having a coating. The automated polishing system includes a polisher for polishing the coating on the article and a robotic positioner for moving the polisher relative to the article on an automated path, wherein the polisher polishes at least a part of the coating during movement. The automated polishing system further includes a force feedback sensor for determining a force of the polisher against the article during polishing, and a controller for maintaining the polisher within a predetermined force range against the article based at least in part on the force determined by the force feedback sensor.

In another embodiment, a method is disclosed for polishing an article having a coating. The method includes moving a polisher relative to the article on an automated path using a robotic positioner, wherein the polisher polishes at least a part of the coating during movement, determining a force of the polisher against the article during polishing using a force feedback sensor, and adjusting the movement of the polisher along the automated path to maintain the force of the polisher against the article within a predetermined force range based at least in part on the force determined by the force feedback sensor.

These and additional features provided by the embodiments discussed herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
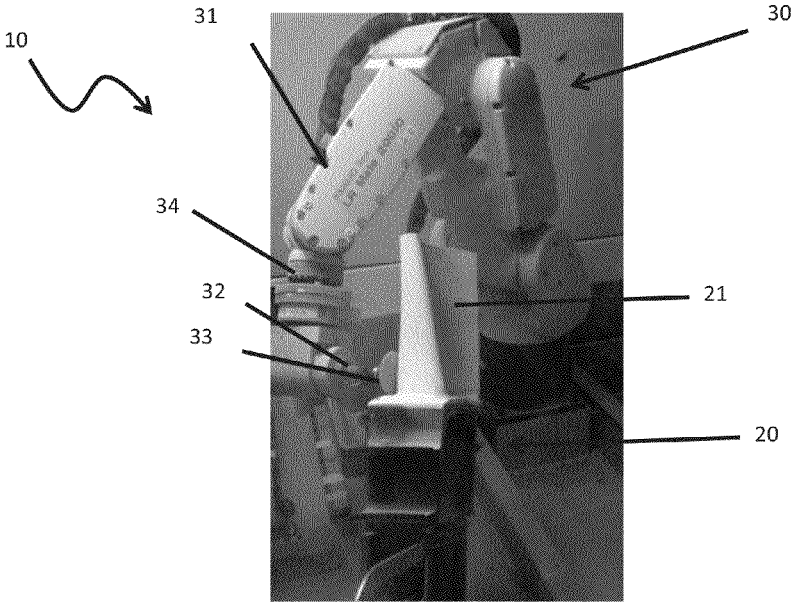
FIG. 1 is a schematic illustration of an automated polishing system according to one or more embodiments shown or described herein.

Referring now to FIG. 1, an automated polishing system 10 is illustrated for polishing an article 20 having a coating 21. The automated polishing system 10 generally comprises a polisher 33 for polishing the coating 21 on the article 20, a robotic positioner 30 for moving the polisher, a force feedback sensor 32 for determining a force between the polisher 33 and the article 20 during polishing, and a controller 50 maintaining the polisher 33 within a predetermined force range against the article 20 based at least in part on the force determined by the force feedback sensor 32.

The polisher 33 can comprise any apparatus suitable for polishing the coating 21 on the article 20 as will become appreciated herein. As used herein, "polishing" refers to any operation involving the polishing, smoothing, blending, grinding or the like of the surface and/or thickness of the coating 21 on the article 20. For example, in some embodiments, the polisher 33 can comprise a diamond disk. In some embodiments, the polisher 33 can comprise any other disk or pad comprising another grit (e.g., sand, stone or the like) capable of removing at least part of the coating 21 on the article 20. In even some embodiments, the polisher 33 may comprise a plurality of materials or may otherwise be interchangeable with different polishing materials so that the coating 21 on the article 20 may be polished using a variety of materials.

In some embodiments, the polisher 33 may comprise a material that is capable of polishing the coating 21 of the article 20 but not capable of wearing down the article 20 itself. Such embodiments may help ensure only the coating is polished during operation without risk of changing the profile of the underlying article 20. While certain types of polishers 33 have been listed herein, it should be appreciated that these are exemplary only and other polishers may additionally or alternatively be incorporated based on other considerations such as type of coating to be polished, cost, durability, availability, or the like.

As discussed above and exemplary illustrated in FIG. 1, the automated polishing system 10 further comprises the robotic positioner 30. The robotic positioner 30 moves the polisher 33 relative to the article 20 on an automated path so that the polisher 33 polishes at least a part of the coating 21 during this movement. In some embodiments, the robotic positioner 30 is connected to the polisher 33 so that it moves the polisher 33 relative to a stationary article 20. In other embodiments, the robotic positioner 30 is connected to the article 20 so that it moves the article 20 relative to a stationary polisher 33. In even some embodiments, the automated polishing system 10 is connected to both the polisher 33 and the article 20 so that it can move both elements relative to one another. In even other embodiments, the automated polishing system 10 may comprise multiple robotic positioners 30 connected in any combination to the one or more polishers 33 and one or more articles 20.

The robotic positioner 30 may itself comprise any machine or device that can move the polisher 33 relative to the article 20 on an automated path. For example, in some embodiments, the robotic positioner 30 may comprise one or more articulating arms 31 integrated with one or more motors 34 that are each capable of movement (e.g., lateral, angular, or rotational) in one or more directions. For example, the robotic positioner 30 may comprise an LR Mate model robot commercially available from FANUC Robotics. The robotic positioner 30 may incorporate any suitable positioning system such as visual, mechanical or computer aided positioning systems. Moreover, while specific types and setups of the robotic positioner 30 have been described herein, it should be appreciated that these are not intended to be limiting and additional and/or alternative robotic positioners 30 may also be incorporated.

As discussed above, the automated polishing system 10 further comprises a force feedback sensor 32 for determining the force between the polisher 33 and the article 20 when polishing. The force feedback sensor 32 can comprise any mechanical, electrical or other system to determine the amount of force between the polisher 33 and the article 20. In some embodiments, the force feedback sensor 32 can comprise a multi-directional or a multi-axial force feedback sensor 32. For example, in some embodiments the force feedback sensor 32 may comprise a spring that compresses and expands based on present forces. In other embodiments, the force feedback sensor 32 may comprise a piezoelectric device that produces a change in electrical charge based on a change in force between the polisher 33 and the article 20. In even other embodiments, the force feedback sensor 32 may additionally or alternatively comprise any other suitable device for determining the force between the polisher 33 and the article 20 during polishing.

The force feedback sensor 32 may be incorporated into the automated polishing system 10 that is suitable for determining the force between the polisher 33 and the article 20. For example, in some embodiments the force feedback sensor 32 may be disposed directly at a connection between the polisher 33 and the robotic positioner 30. In some embodiments, the force feedback sensor 32 may be disposed directly at a connection between the article 20 and the robotic positioner 30.

Figure 2:
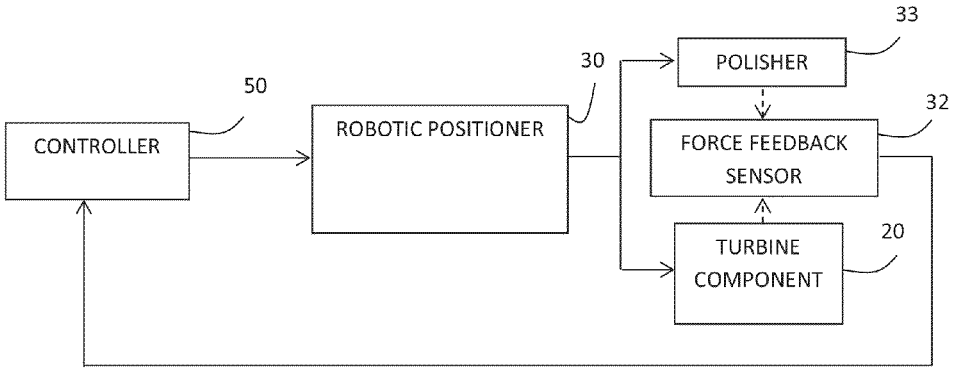
FIG. 2 is a block diagram of a controller interacting with the automated polishing system according to one or more embodiments shown or described herein.

Referring now to FIGS. 1 and 2, the automated polishing system 10 further comprises a controller 50 for maintaining the polisher 33 within a predetermined force range against the article 20 based at least in part on the force determined by the force feedback sensor 32.

FIG. 2 depicts an exemplary diagram of the interaction between the controller 50 and other components of the automated polishing system 10. The controller 50 can comprise any integrated or stand-alone computer system that can receive feedback from at least the force feedback sensor 32 as well as determine any necessary corrective action (such as through adjusting the movement of the robotic positioner 30) to maintain the polisher within a predetermined force range against the article.

For example, the controller 50 can comprise one or more communication interfaces for receiving the force determination from the force feedback sensor 32 and communicating movement instructions to the robotic positioner 30, memory for storing the automated path and/or algorithms for determining the automated path, and a processor for determining any necessary adjustments to maintain the polisher 33 within a predetermined force range against the article 20.

The controller 50 may thus first receive or determine the automated path so that it can instruct the robotic positioner 30 of the necessary movement between the polisher 33 and the article 20. The automated path comprises the path the polisher 33 takes to polish one or more areas of the coating 21 on the article 20. For example, the automated path may comprise a path that allows for the polisher 33 to contact and polish the entire surface area of the article 20. In some embodiments, the automated path may comprise a path that has the polisher 33 only contact a portion of the article 20, such as only a single face, side, edge or the like. The automated path may also dictate a single pass or multiple passes over the article 20 depending, for example, on the amount of polishing required for the specific article 20 being polished.

In some embodiments, the automated path itself is provided to the controller 50 such as through preprogrammed storage or external communication. In other embodiments, the controller 50 is only provided one or more parameter inputs so that it determines the automated path itself. In such embodiments, the variety of parameter inputs may include, for example, the size, shape and/or dimensions of the article 20, the type and/or thickness of the coating 21, the type of polisher 33 that will be used on the coating 21, the presence of specific features (e.g., cooling holes, overspray) on the article 20, or the like.

In some embodiments, the article 20 may undergo an initial inspection prior to polishing. The initial inspection can comprise any visual, electrical, mechanical, chemical or other inspection to analyze the article 20 and/or the coating 21. For example, in some embodiments the coating 21 itself may be inspected to determine its thickness, smoothness or other characteristics prior to polishing. Such inspection may be achieved, for example, through eddy current analysis or other suitable inspection techniques and may occur using the same robotic positioner that is subsequently used for polishing. The results of the initial inspection may then be used to change one or more polishing parameters during polishing. As used herein, "polishing parameters" refer to any variable parameter that can change the polishing result. Polishing parameters can include, for example, the rotations per minute (RPM) of the polisher 33, the polishing angle of the polisher 33, the travel speed of the polisher 33 across the article 20, or the predetermined force range as should be appreciated herein. For example, if the initial inspection determines the coating thickness is thicker in certain areas, the polishing parameters along the automated path can ensure those thicker areas are polished for a longer period (e.g., slower travel time) of time or at a higher polishing rate (e.g., RPM) to reduce the thicker areas of the coating a provide a more uniform coating 21 over the entire article 20.

Other initial inspection techniques may include the identifying and locating of cooling holes or other features of the article 20. Special consideration of these features can be taken into account when determining the automated path and/or polishing parameters. As discussed above, the results of the initial inspection may thereby be used to determine the automated path such that the automated path is provided directly to the controller 50, or the results of the initial inspection themselves may be provided to the controller 50, so that the controller 50 can determine the automated path.

Once the controller 50 has the automated path, the controller 50 communicates with the robotic positioner 30 to move the polisher 33 relative to the article 20 on said automated path. For example, the robotic positioner 30 may move the polisher 33 relative the stationary work piece 20 (as illustrated in FIGS. 1 and 2), may move the work piece 20 relative the stationary polisher 33, or combinations thereof. While the article 20 is being polished by the polisher 33, the force feedback sensor 32 is determining the amount of force between the polisher 33 and the article 20 and communicating said force to the controller 50.

The force between the polisher 33 and the article 20 can change based on the geometry of the article 20 and any variations therein. The automated path may take the polisher 33 around the article 20 such that it maintains in contact with the article 20. Specifically, by contacting the article 20, the polisher 33 and the article 20 will have a force there between. When the article 20 possesses additional material (such as an extra protrusion or contour on the surface), the force between the polisher 33 and the article 20 may increase. Conversely, when the article 20 has less material then expected (such as an extra dip in the surface), the force between the polisher 33 and the article 20 may decrease. The force between the polisher 33 and the article 20 can then vary based, for example, on the geometry of the article 20.

The force determined by the force feedback sensor 32 is then communicated to the controller 50, either directly or indirectly, so that the controller 50 can maintain the polisher within a predetermined force range against the article and potentially change one or more polishing parameters of the polisher 33 while polishing along the automated path. Adjusting polishing parameters of the polisher 33 can include adjusting a variety of different parameters related to the polishing process. For example, adjusting polishing parameters of the polisher 33 can include adjusting the rotations per minute (RPM) of the polisher 33, the polishing angle of the polisher 33, the travel speed of the polisher 33 across the article 20, or the predetermined force range as should be appreciated herein. These and additional polishing parameters can be adjusted to ensure the coating 21 receives a uniform treatment and/or ensure the coating obtains a uniform thickness, smoothness or the like. For example, thicker, rougher or other types of coatings that may require additional work can have the RPMs increased, the travel speed decreased (so that it polishes for a longer period of time) or otherwise change one or more polishing parameters to account for the variances in the coating 21. In some embodiments, the predetermined force range may be changed for specific locations such as to allow for a higher or lower force than would otherwise be acceptable. Such changes may allow for special treatment of particularly damaged areas on the coating 21.

The force feedback sensor 32 can thereby continuously or intermittently determine the force of the polisher 33 against the article 20 and provide the determined force to the controller 50. The controller 50 can then make any adjustments to the polisher 33 to account for changes in the force so that it is maintained within a predetermined force range. The predetermined force range can be any range of force having a maximum and minimum and may be based on the desired polishing effect. For example, while the same automated path may be utilized for the same type of articles 20, the force feedback sensor 32 can detect any variations unique to a specific article 20 that would could the force to increase or decrease potentially affecting the resulting polish. Thus, the automated polishing system 10 can maintain the efficiency and reliability of an automated process while still taking into account the unique variances that occur in articles 20 having a coating 21.

In addition to polishing the article 20 using the force between the polisher 33 and the article 20 determined by the force feedback sensor 32, the automated polishing system 10 can additionally or alternatively perform a variety of other operations and/or incorporate one or more other factors. For example, in some embodiments, the automated polishing system 10 may account for additional features in the article 20 through initial inspection, polishing and/or further processing steps.

For example, in some embodiments, the article 20 may comprise cooling holes. The location of the cooling holes may be determined through an initial inspection such as through an identification system (e.g., a visual identification system). For example, the identification system can locate the cooling holes prior to polishing the article 20 so that the controller 50 can account for the cooling holes during the polishing process. In even some embodiments, the automated polishing system 10 may comprise a hole clearing device that can clear the cooling holes identified by the identification system. For example, the automated polishing system 10 can comprise a diamond reamer or hone that can clear any coating overspray or other debris that may be blocking the cooling holes. In even some embodiments, the hole clearing device can clear the cooling holes using the force feedback sensor 32. For example, the hole clearing device can clear the coating 21 until it starts to contact the article 20, itself. Once the hole clearing device contacts the article 20, there will be an increase in force due to the increased strength of the article 20 compared to the coating 22. Thus, the force feedback sensor 32 can be utilized to monitor the hole clearing device be relaying the increase in force from the article 20 to the controller 50 so that hole clearing can stop.

The identification system can thereby identify the cooling holes during an initial inspection and have the hole clearing device clear the cooling holes after polishing to make sure any overspray, dust or other debris is cleared. In some embodiments, the automated polishing system 10 may also comprise a vacuum to operate in series or parallel with the polishing and vacuum up any debris. Furthermore, the identification system, hole clearing device, vacuum and any other additional systems may each potentially utilize the same robotic positioner 30 as the polisher 33 to help maintain calibration between the various tools.

Figure 3:
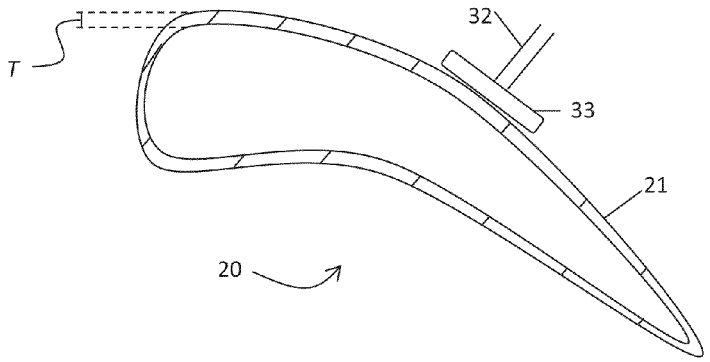
FIG. 3 is a cross sectional view of a turbine component with part of the automated polishing system according to one or more embodiments shown or described herein; and, FIG. 4 is an exemplary method for polishing an article having a coating according to one or more embodiments shown or described herein.

Referring now to FIGS. 1 and 3, the automated polishing system 10 can be used on any article 20 having a coating 21. The article 20 can comprise any article such as a turbine component used in a gas turbine, steam turbine or the like. In some embodiments, the article 20 can comprise a blade, bucket, vane, nozzle, liner, transition piece, shroud or the like. In some embodiments, the article 20 can comprise a hot gas path component for a turbine.

Moreover, the coating 21 can comprise any coating that may be utilized for its performance such as those used in a turbine environment. For example, in some embodiments, the coating 21 can comprise a thermal barrier coating such as yttria stabilized zirconia. Such embodiments may be utilized when the article 20 comprises a turbine blade or other hot gas path component. The coating 21 can comprise any thickness T that is either uniform or varied about the surface of the article 20. In some embodiments, the coating 21 may cover the entire surface area of the article 20. In other embodiments, the coating 21 may cover just a portion of the surface area of the article 20. It should be appreciated that while specific articles 20 and coatings 21 have been listed herein, these are exemplary only and other non-listed articles 20 and coatings 21 may additionally or alternatively be incorporated.

Figure 4:
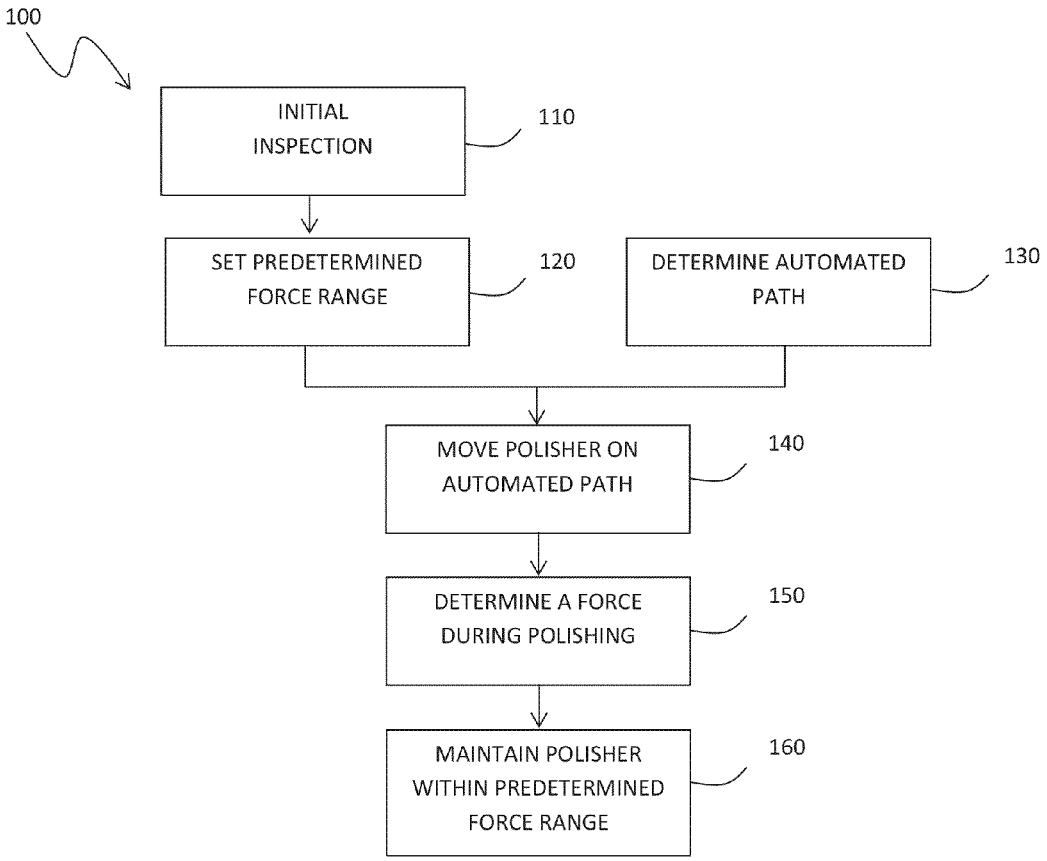

Referring now to FIG. 4, a method 100 is illustrated for polishing an article having a coating. The method 100 may be carried out, for example, using the automated polishing system 10 discussed above and illustrated in FIGS. 1-3. The method 100 first potentially comprises an initial inspection of the article 20 in step 110. The initial inspection can inspect the coating 21 to determine the amount of polishing required at different areas of the article 20, the location of specific features such as cooling holes, or any other suitable data relevant to the subsequent polishing. The method 100 then comprises (either with or without the initial inspection), setting a predetermined force range in step 120. As discussed above, the predetermined force range will be the range in force utilized between the polisher 33 and the article 20. The predetermined force range determined in step 120 can depend, for example, on the toughness or thickness of the coating, the type of polisher 33, the tolerance of the final part, or the like. Furthermore, the method 100 comprises determining the automated path in step 130. As discussed above, the automated path comprises the path the polisher 33 takes to polish one or more areas of the coating 21 on the article 20. The automated path 20 may be predetermined based on the type of part, may be determined specifically for each part, or may even be determined based on an initial inspection such as the one in step 110.

Once the predetermined force range is set in step 120 and the automated path is determined in step 130, the method 100 then comprises moving the polisher 33 relative to the article 20 on an automated path in step 140. As discussed above, the polisher 33 moves on the automated path to polish at least a part of the coating 21 on the article 20. While the polisher 33 is being moved relative to the article 20 in step 140, a force is determined in step 150 of the polisher 33 against the article 20. The force determined in step 150 may thereby be utilized to adjust movement of the polisher 33 to maintain the polisher within the predetermined force range in step 160. Specifically, the force determined in step 150 can be used to adjust the movement of the polisher 33 in step 160 to ensure that all polishing across the article 20 occurs within a predetermined force range despite any local variances in shape. In some embodiments (not illustrated), the method 100 may further comprise changing one or more polishing parameters while polishing. As discussed, the polishing parameters (e.g., RPM, travel speed, contact angle, or the predetermined force range) can be changed based on the initial inspection or any other known factors relating to the coating 21 on the article 20 at one or more locations.

It should now be appreciated that automated polishing systems and methods can automatically polish coatings on articles (e.g., turbine components) while dynamically accounting for the force between the polisher and the article as the polisher polishes on an automated path. The force determined between the polisher and the article can be maintained within a predetermined range to actively adjust the movement of the polisher and maintain consistent, quality polishing across the article.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An automated polishing system for polishing an article having a coating, the automated polisher comprising:

a polisher for polishing the coating on the article;

a robotic positioner for moving the polisher relative to the article on an automated path, wherein the polisher polishes at least a part of the coating during movement;

a force feedback sensor for determining a force of the polisher against the article during polishing; and, a controller for maintaining the polisher within a predetermined force range against the article based at least in part on the force determined by the force feedback sensor, wherein the controller changes one or more polishing parameters of the polisher while polishing, wherein the one or more polishing parameters are changed based on an initial inspection of the article prior to polishing, and wherein the initial inspection identifies locations of cooling holes in the article.

2. The automated polishing system of claim 1, wherein the initial inspection comprises an eddy current inspection of the article.

3. The automated polishing system of claim 1, wherein initial inspection utilizes the robotic positioner.

4. The automated polishing system of claim 1 further comprising a cooling hole clearing device for clearing the cooling holes identified by the initial inspection.

5. The automated polishing system of claim 1, wherein the one or more polishing parameters comprises an RPM of the polisher.

6. The automated polishing system of claim 1, wherein the one or more polishing parameters comprises a polishing angle of the polisher against the article.

7. The automated polishing system of claim 1, wherein the one or more polishing parameters comprises a travel speed of the polisher across the article.

8. The automated polishing system of claim 1, wherein the one or more polishing parameters comprises the predetermined force range.

9. The automated polishing system of claim 1, wherein the article comprise a turbine component.

10. A method for polishing an article having a coating, the method comprising:

moving a polisher relative to the article on an automated path using a robotic positioner, wherein the polisher polishes at least a part of the coating during movement;

determining a force of the polisher against the article during polishing using a force feedback sensor;

adjusting the movement of the polisher along the automated path to maintain the force of the polisher against the article within a predetermined force range based at least in part on the force determined by the force feedback sensor; and, changing one or more polishing parameters while polishing, wherein the one or more polishing parameters are changed based on an initial inspection of the article prior to polishing, and wherein the initial inspection identifies locations of cooling holes in the article.

11. The method of claim 10 further comprising clearing the one or more cooling holes using a hole clearing device after polishing at least a part of the coating.

12. The method of claim 11, wherein the force feedback sensor determines a clearing force of the hole clearing device against the article when clearing the one or more cooling holes.

13. The method of claim 10, wherein moving the polisher relative to the article comprises moving the polisher while keeping the article stationary.

14. The method of claim 10, wherein the article comprises a turbine component.

* * * * *